US005321935A

United States Patent [19]

Spatz et al.

[11] Patent Number: 5,321,935

[45] Date of Patent: Jun. 21, 1994

[54] SLEWING DEVICE FOR SCREW CAPS AND METHOD FOR PUTTING SCREW CAPS ON CONTAINERS

[75] Inventors: Günter Spatz, Biblis; Wolfhard Schwarz, Worms, both of Fed. Rep. of Germany

[73] Assignee: Alcoa Deutschland GmbH, Worms, Fed. Rep. of Germany

[21] Appl. No.: 934,542

[22] PCT Filed: Mar. 2, 1991

[86] PCT No.: PCT/EP91/00394

§ 371 Date: Oct. 8, 1992

§ 102(e) Date: Oct. 8, 1992

[87] PCT Pub. No.: WO91/15422

PCT Pub. Date: Oct. 17, 1991

[30] Foreign Application Priority Data

Apr. 9, 1990 [DE] Fed. Rep. of Germany ..... 4011398

[51] Int. Cl.[5] ..... B67B 3/20; B67B 3/26; B65B 7/28

[52] U.S. Cl. ..... 53/490; 53/53; 53/75; 53/77; 53/317; 53/331.5

[58] Field of Search ..... 53/490, 75, 77, 76, 53/317, 331.5, 53

[56] References Cited

U.S. PATENT DOCUMENTS 4,535,583 8/1985 Tanaka et al. ..... 53/331.5 X 4,614,077 9/1986 Muto et al. ..... 53/331.5 X 4,616,466 10/1986 Tanaka et al. ..... 53/317 X

FOREIGN PATENT DOCUMENTS 3715935 11/1988 Fed. Rep. of Germany .

2629440 10/1989 France .

*Primary Examiner*—Horace M. Culver

*Attorney, Agent, or Firm*—Anderson Kill Olick & Oshinsky

[57] ABSTRACT

A slewing device for screw closures for containers includes a screw closure receiving member, a drive for rotating the receiving member, and a control arrangement for controlling power supply to the drive and including a torque sensor for sensing an instantaneous drive torque, a comparator for comparing the instantaneous drive torque with a closing torque having a predetermined value, and a sensor for sensing an angle of rotation of the receiving member and actuatable only upon the instantaneous drive torque reaching the predetermine value. The method of placing a screw closure on a container includes applying a drive torque to the screw closure to screw it down onto the container, sensing an instantaneous drive torque applied to the screw closure, comparing the instantaneous drive torque with a closing torque having a predetermined value, and sensing an angle of rotation of the screw closure only upon the instantaneous drive torque reaching the predetermined value of the closing torque.

13 Claims, 1 Drawing Sheet

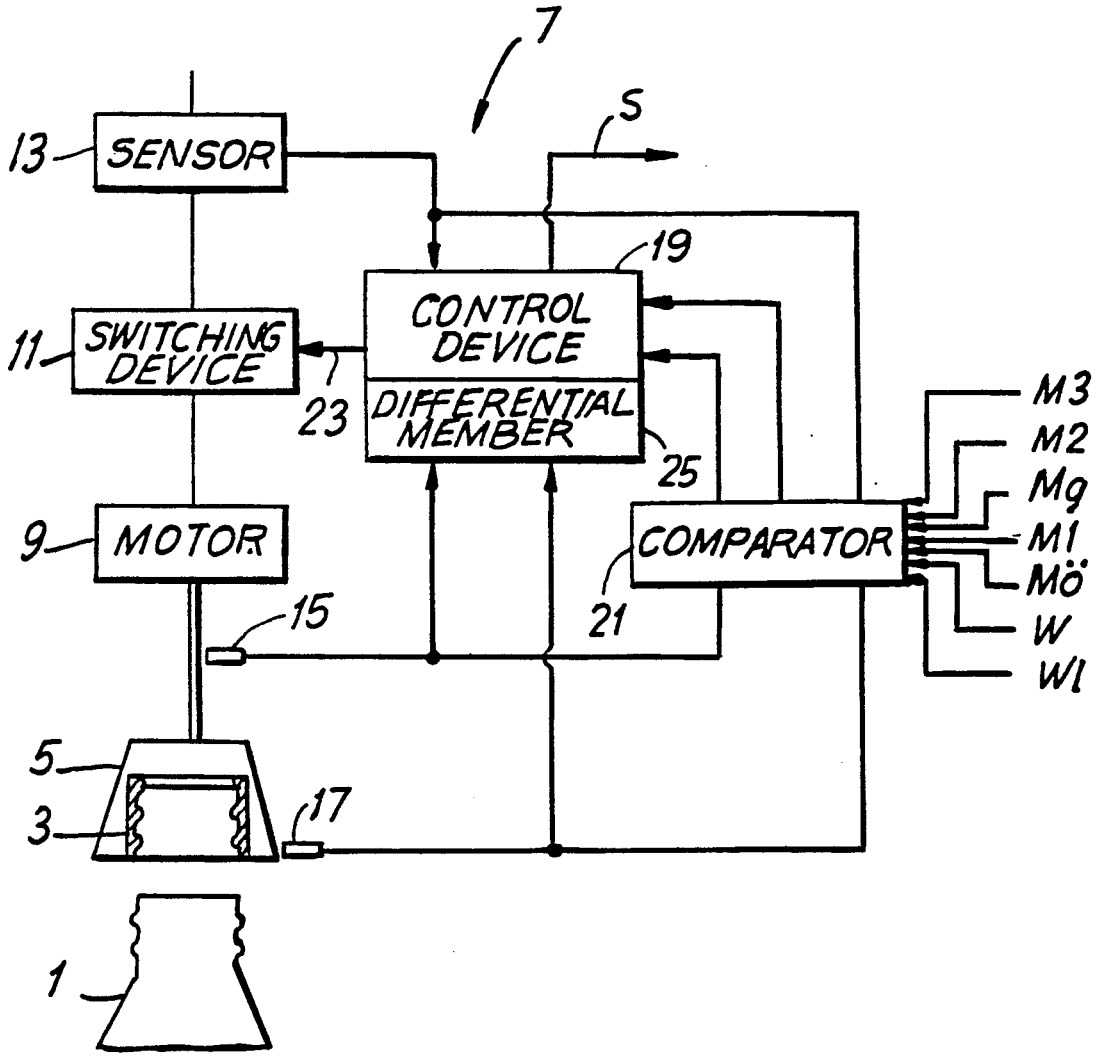
7
S
13
SENSOR
19
CONTROL DEVICE
11
SWITCHING DEVICE
23
DIFFERENTIAL MEMBER
25
M3
M2
Mg
M1
Mö
W
Wl
9
MOTOR
COMPARATOR
21
15
5
3
17
1

SLEWING DEVICE FOR SCREW CAPS AND METHOD FOR PUTTING SCREW CAPS ON CONTAINERS

BACKGROUND OF THE INVENTION

The invention relates to a slewing device for screw closures, in particular, from plastic materials, for containers and comprising a drive and a torque limiter for controlling power supply to the drive and including a torque sensor and an angle of rotation sensor, and a method of placing screw closures on containers using the slewing device according to the invention.

A slewing device for screw caps or screw closures as well as a method for putting such closures or caps on containers are known (DE-OS 37 15 935). The known slewing mechanism serves for screwing screw caps onto receptacles and observe herein a preset closing moment. A torque limiter prevents exceeding the desired moment. For this purpose a control circuit measures the drive current absorbed by the drive motor of the rotational device and triggers control signals if the current rises to a specific value corresponding to a specific torque of the threaded-on cap or closure, by means of which the drive current of the drive motor is interrupted. Thus one directly affects the energy supply of the drive.

However it was seen that in some cases especially when using solid plastic closures, a secure sealing of the container is not achievable also when presetting a specific closure moment. This applies especially when containers or bottles subjected to an overpressure are to be closed. By presetting a specific closure moment it is in addition possible to damage the mouth region of the container to be closed, especially with glass bottles, which leads to danger for the consumer. Finally it is seen, that the opening moment, meaning torque required for initial opening of the container, is often considerably higher than desired.

It is therefore the task of the invention to create a slewing mechanism as well as a method, by means of which containers with screw closures, especially also those made of plastics material, can be closed, wherein containers subjected to overpressure are closed in a pressure-tight manner however without being damaged in the mouth region and where a specific opening moment is set up.

SUMMARY OF THE INVENTION

This task is solved in a slewing mechanism in which the torque limiter determines the angle of rotation only after a predetermined closing torque is reached. Since the control arrangement or the torque limiter determines to begin with by means of a torque sensor whether a specific closure moment, the application or applied moment, is reached during a closure process, a defined point of departure or point of reference for the additional measurement during the closure process is established. After reaching this application moment the angle of rotation is acquired, through which the screw closure is turned by the slewing mechanism. A particularly sensitive closure of the container is assured by acquisition of the angle of rotation after reaching the application moment. This permits to exclude damage to the mouth area with a high degree of certainty and to assure a very precise observation of a desired opening moment.

In a preferred embodiment of the slewing mechanism or device the control arrangement is laid out in such a way, that the angle of rotation through which the screw cap or screw closure continues to be turned after reaching a predetermined application moment can be limited to a presettable value. This layout of the slewing device results in a particularly sensitive adjustment of the desired closing moment, wherein the predetermined opening moment can be observed very accurately.

In a preferred embodiment form of the slewing mechanism the torque acting upon the screw closure is acquired by means of the control arrangement serving as torque limiter. Herein the current fed to the drive or the voltage applied to the drive of the slewing device is registered. Since the power absorbed by the drive is proportional to the voltage or to the current, the momentary torque can be determined from the momentary value of the current or the voltage. This determination of the moment is particularly easy to perform.

In an additional preferred closure mechanism the chronological change of the tightening moment is determined or registered. If thus the cap or closure suddenly hangs up or tilts when being threaded on, which is recognized by a rapid rise of the moment per unit time, the closure process can be broken off, so that the mouth region of the container is not damaged.

The described task is solved by means of a method in which the screw closure is screwed down until it reaches a predetermined closing moment and, thereafter, an angle of rotation and/or a chronological change is determined. In order to achieve a particularly sensitive control of the desired closure moment, the cap or closure is to begin with threaded onto the container until a predetermined tightening moment, the application moment, has been reached. With this a defined initial state of the closure process is reached. After this the closure or cap continues to be turned through a predeterminable angle of rotation relative to the container. This leads to a secure setup of the desired closure moment, wherein damage to the mouth of the container are to all intents and purposes eliminated.

According to a preferred embodiment form of the method the chronological change of the tightening moment is additionally registered after the application moment has been reached. Obstructions or troubles in the method during this phase, for instance tilting of the closure on the container can thus be safely determined.

Finally an embodiment form of the method is preferred, where the screw closure or cap is threaded on up to attaining a high limiting moment exceeding the closure moment. Subsequently the closure is turned in opposite direction through a predeterminable angle of turn, in order to set up the desired closure moment and with this also a specific opening moment. It is particularly advantageous in this method that containers whose threads have minor damage can also be closed; in this case an increased closure moment must therefore be applied in order to thread the closure onto the container.

Even if the closure is for instance provided with a safety ring a higher torque must be applied when closing, because the closing moment could often already be reached, before the screw closure is in its final position. Through the initially selected high limiting moment a particularly good contact pressure of the seal against the mouth region of the container is assured, so that minor damage is compensated. A particularly good sealing of the container is achieved in this manner.

BRIEF DESCRIPTION OF THE DRAWINGS

Single FIGURE of the drawing shows a schematic view of a slewing device according to the present invention.

DETAILED DESCRIPTION OF THE PREFERRED EMBODIMENT

The drawing shows a container 1, in this case a bottle, on which a screw cap 3 of a plastics material is to be threaded or screwed on. The closure or cap is gripped by a sketched closing cone 5 of a slewing device 7 and is placed upon the container 1. Herein it is unimportant for the invention, whether the closing cone 5 is turned with respect to the container 1, or whether the closure cone remains stationary and the container 1 rotates.

The closure cone 5 is rotated in this case by a motor 9 serving as a drive, which is supplied with current or voltage through a switching device 11. A sensor 13 is provided between the energy supply and the switching arrangement, which sensor determines the current or the voltage. Basically it is also possible to provide the sensor 13 between the switching device 11 and the motor 9.

A torque sensor 15 determining the torque is allocated to the motor 9 or the closure cone 5, which determines or acquires the closure moment acting upon the screw closure 3. In addition an angle of rotation sensor 17 is allocated to the closure cone 5, which determines the angular position of the cone.

An elongation measuring strip system (DMS) integrated into a not explicitly shown spindle of the motor 5 is preferably used as a torque sensor 15. An opto-electronic incremental transmitter is preferred for angular measurement.

The signals of the current- or voltage-sensor 13, the torque sensor 15 and the angle of rotation sensor 17 are fed to a control arrangement 19 which evaluates and processes the measured values. In addition these signals are fed to a comparator circuit 21. This comparator circuit contains also values M1, M2, M3, M7, and Mö for predetermined tightening moments presettable by suitable actuators as well as specific values W and W1 for predetermined angles of rotation. The output signals of the comparator circuit 21 are fed to a control arrangement 19.

The control apparatus 19 is connected by a control line 23 with the switching device 11 of the motor 9. In addition it is provided with a differential member 25, to which the output signals of the torque- and angle of rotation sensor are fed.

Sensor 13 registering the supply voltage and/or the supply current of the motor 9 serves to determine the torque momentarily generated by the motor, wherein one proceeds from the circumstance that the moment is proportional to the voltage or of the current. By determining the chronological change of the supply voltage or the supply current of the motor the chronological changes of the torque can also be acquired. In this case the torque sensor 15, which is described above, could be eliminated.

In the following the mode of operation of the slewing device 7 as well as the method for closing containers is described in more detail.

Basically the device and the method are suitable for closing any type of container. The use of the device or the method for closing bottles by plastics caps is preferred. The bottles can herein consist of glass or on their part also of a plastics material, for instance PET.

The screw closure 3 is introduced into the closure cone 5 in any random manner, for instance by means of a so-called pick method. Subsequently the closure cone with the screw closure 3 clamped therein is disposed above the container 1 which is to be sealed or closed off. Herein in this case the closure cone 5 rotates relative to the stationary container 1.

The rotating screw closure 1 is now placed upon the container 1. For this purpose an appropriate switching signal is issued by the control arrangement 19 through the control line 23 to the switching device 11 comprising for instance an electronic switch or a relay, so that the motor 9 is supplied with energy. During the tightening of the closure 3 on the container 1 the closure moment or the tightening moment exerted by the motor 9 upon the closure cone 5 or the screw closure 3 is determined. The momentary or instantaneous moment can first of all be determined by the sensor 13, which registers the current or the voltage supply by the energy supplied to the motor 9. It is also possible to determine the moment transferred from the motor 9 to the closure cone 5 by means of a torque sensor 15. The output signal of the sensor 13 or the torque sensor 15 is directed to the control arrangement 19 however also to the comparator 21. The comparator compares the actual momentary value with a predeterminable tightening moment M1, the so-called application moment. As soon as this moment M1 is reached, the angular rotation sensor 17 is activated by the control device 19. The control device 19 now evaluates the signals of the angle of rotation sensor. The actual angle of rotation of the closure cone 5 or the closure 3 is compared in the comparator 21 with a predetermined angular value W. As soon as the closure is additionally screwed down through the desired angle of rotation W after reaching the application moment M1, the control device 19 issues a signal to the switching arrangement 11 through the line 23, so that said switching arrangement interrupts the energy supply to the motor 9. Thus a further turning of the closure is prevented.

If the current- or voltage sensor 13 is utilized, the angle of rotation sensor 17 can be eliminated. The moment supplied by the motor 9 can be determined in such an accurate manner, that the switching arrangement 11 is actuated in such a way through the control arrangement 19 and the control line 23, that the motor 9 is switched off. In a DC motor the torque is proportional to the current or voltage applied to the motor. If only a lower accuracy is desired when reaching the closure moment M2, this method of closing containers is adequate.

If the application moment M1 or the closure moment are not reached, then the following conclusion can be drawn therefrom:

The closure or cap has dropped out of the closure cone prior to reaching the container, no container has been moved beneath the closure cone due to a control error or however the thread of the container or the internal thread of the closure is ruined.

The control arrangement 19 can for instance be provided with a timing member, which presets a specific time within which the application- or the closure moment must have been reached. If this is not the case, a control signal is issued through a signal line S and the container 1 momentarily arranged beneath the closure cone 5 is removed from the closing installation.

Instead of presetting a specific time period, which is allowed at the most to elapse before the application moment M1 is reached, a specific angle of rotation can also be preset. This means the closure is for instance threaded onto the container through a complete revolution. After that the application moment must have been reached. Should this not be the case then one deduces therefrom that damage is present at the container or the closure cap. This particular container is then removed.

If however on the other hand the application moment M1 is reached and the angular rotation sensor 17 has been activated by the control arrangement 19, the closure cone 5 is rotated further, until the momentary angle of rotation reaches the value W entered into the comparator 21. The predetermined angle of rotation W is fixed as a result of tests. Thus it is assured, that the desired closure moment M2 is reached. It is on the one hand assured with such a predetermined closure moment, that the container is closed or sealed by the screw closure 3 in a pressure-tight manner. On the other hand it assures that the opening moment Mö required for initially opening the container is also adhered to.

While the screw closure 3 continues to be turned through the predetermined angle of rotation W, the momentary tightening moment can continue to be monitored by the torque sensor 15 and to be compared in the comparator circuit 21 with a second moment value, a predetermined maximum value of M3. If this maximum value M3 is attained during further turning of the closure, then one can deduce that a defective mouth of the bottle exists. If for instance the threads on the container exterior are nicked, then they cut into the internal wall or the threads of the plastics screw closure 3. The moment required for further turning of the closure thus increases steeply, to such an extent that the predetermined maximum value M3 is exceeded.

If in the course of continued rotation of the closure cone 5 up to attaining the predetermined angle of rotation W, the maximum value of the desired application moment M3 is exceeded, then this can also be due to the internal thread being damaged in the course of its continued extent inside of the screw closure 3. Because of this the cap or closure cannot be screwed on sufficiently far, so that the seal provided there does not come into adequate engagement with the mouth region of the container 1. An internal pressure existing in the container can easily escape. Therefore in such a case a signal is also issued through the control line S of the control arrangement 19, so that this container is separated out of the closing installation. In addition each time when the maximum moment M3 is exceeded prior to the predetermined angle of rotation W being reached, the switching arrangement 11 is actuated in such a way through the control line 23, that the motor 9 no longer drives the closing cone 5. This prevents applying an excessively large torque to the mouth area of the container 1 and that consequently damage occurs.

Finally the maximum tightening moment M3 could be exceeded also prior to reaching the desired angle of rotation W, if the closure or cap 3 tilts on the thread of the container after the application moment M1 has been reached. On the one hand it would also not be assured in that case, that the seal disposed in the cap seals the container pressure in a tight manner, on the other hand, if the closure process is continued because of the tilting, an excessive moment can come to act on the mouth region of the container and cause damage.

A differential member 25 is provided here within the control arrangement 19, which determines the chronological derivation of the output signal of the torque sensor 15 but also of the output signal of the angle of rotation sensor 17.

From an excessively large chronological change of the angle of rotation determined by this differential member 25, it can for instance also be determined when the closure cone 5 suddenly spins or races, that thus screw cap closure 3 is no longer supported on the container 1. This can for instance occur if the side wall of the cap has split or if the thread of the container has failed. In such a case a signal is issued through the control S and the container involved is separated out.

If it is seen that the increase of the torque after reaching the application moment M1 and prior to reaching the desired angle of rotation W is too small, then one can draw therefrom the conclusion, that either the seal in the cap is defective, that the cap was fractured already prior to the application onto the container or that the bottle thread was inaccurately shaped. In any case one can draw the conclusion therefrom, that the cap will race or spin on the container. In this case also the corresponding container is separated out by a signal in the control line S.

If on the other hand the torque rises too rapidly after the application moment M1 has been reached, and prior to reaching the desired angle of rotation W, then one can conclude therefrom, that damage has occurred at the thread of the cap or the container or that the cap or closure has tilted on the container. In this case also a signal is issued through the control line S and the appropriate container is separated out.

Because a maximum torque M3 is preset for the closure process, the opening moment Mö required for initial opening of the container can be adjusted to a desired value. On the other hand additional security is achieved thereby by being able to recognize tilting of the cap or damage to the thread of the cap or the container and being able to separate out the container involved.

Since the torque and on the other hand the angle of rotation after reaching a predetermined application moment can be preset, the moments occurring during closure of a container by a screw closure or cap can be limited. On the one hand damages to the mouth of the container are excluded thereby, on the other hand overloading the closing device is excluded, so that its wear is reduced to a minimum. The useful life of this mechanism is therefore greatly increased.

The method can be modified inasmuch as the screw closure 3 is screwed down by the motor 9 for as long, until reaching a torque limit value Mg is registered by the torque sensor 15 and the comparator 21, which limit value lies above the closure moment M2.

Due to the increased tightening moment containers 1 with slight thread damage can also be securely sealed or closed. Basically it has to be stated, that in case of damage to the thread the closing moment M2 desired in the final analysis is already reached prior to the cap having assumed a final position on the thread of the container, because additional frictional forces are built up due to the damage.

Also when using caps with a warranty or safety ring intended to indicate the initial opening of the closure, frequently the final desired closing moment M2 is already reached prior to the cap having assumed its final position on the container, because the warranty or safety ring produces an additional frictional moment. Therefore when such closures are used a torque must be applied to begin with which exceeds the final desired closing moment M2.

Finally an optimum contact pressure of the seal against the mouth area of the container is also achieved by the increased tightening moment. Thereby the seal espouses the mouth in such a way that, even if the slight damage is present, an optimum sealing of the container is assured even if the contents of the said container are subjected to overpressure.

In order to avoid that excessive opening moments are set up by closing with an increased tightening moment, a reversal of the energy supplied to the motor 9 is achieved after screwing down the cap up to the limiting moment Mg, this by means of a control signal in the control arrangement 19 which is fed to the switching arrangement 11 through the line 23. The motor then reverses its direction of rotation. At the same time the angle of rotation sensor 17 is activated by this control signal. Its output signals are compared in the comparator 21 with an angular value W1 allocated to the left-hand rotation or the opening motion. As soon as the preset angle of rotation lying for instance in the range of 10° to 15° is achieved as soon as the actual angle of rotation thus reaches the limit value W1 present in the comparator 21, the switching arrangement 11 is controlled in such a way by a control signal of the control device 19 through the control line 23, that the energy supplied to the motor 9 is interrupted. Thereby the opening motion of the cap 3 is terminated.

It is determined by tests how far the screw closure or cap must be turned in opposite direction after it has been screwed down up to the limiting moment Mg, until the desired opening moment Mö is set up. The required angle of rotation can depend upon the combination of the materials selected for the container, cap and seal.

Because the switching arrangement 11 can be activated in such a way, that an energy reversal or a pole reversal of the energy supply to the motor 9 is achieved, it is possible that the rotary device of the type described above is controlled in such a way, that in case of a defect occurring during the closure process of a container to begin with a reversal of rotation is performed and the cap is again unscrewed from the container. Then the closing process is started anew. If now an orderly regular closing process is to be set up, the container is left in the normal manufacturing process. Only if a discrepancy occurs again, for instance because the cap or the mouth area of the container are ruined, is the container mustered out of the process. Removals can in this way be reduced to a minimum; such removals entail that additional processing steps must be performed outside of the normal work sequence. Thus an additional improvement of the closing process can be achieved by reversal of the energy supply.

By the availability of the energy reversal it is also possible to turn the cap 3 counter to the closing direction after the first setup on the container 1. In this way an optimum alignment of the thread provided in the cap with respect to the container thread can occur. After a certain left-hand rotation the cap snaps onto the container, which for instance can be determined by an axial motion of the cap with the respect to the container occurring. This motion can be probed by a suitable travel sensor.

The rotation of the cap counter to the closing direction results with screw closures with a warranty- or safety-ring in that said ring is aligned in an optimal manner. This avoids jamming of the safety ring during the subsequent screw-down of the cap.

We claim:

1. A slewing device for screw closures for containers, comprising:

a screw closure receiving member;

a drive for rotating said receiving member; and control means for controlling power supply to said drive, said control means including:

a torque sensor for sensing an instantaneous drive torque;

comparator means for comparing the instantaneous drive torque with a closing torque having a predetermined value; and a sensor for sensing an angle of rotation of said receiving member and actuatable only upon the instantaneous drive torque reaching the predetermined value.

2. A slewing device according to claim 1, wherein said torque sensor comprises at least one of a current sensor and a voltage sensor forming part of a power supply circuit for said drive.

3. A slewing device according to claim 1, further comprising a power reversal circuit associated with said control means.

4. A slewing device according to claim 3, wherein said torque sensor is associated with said power reversal circuit.

5. A method of placing a screw closure on a container, comprising the steps of:

applying a drive torque to the screw closure to screw it down onto the container;

sensing an instantaneous drive torque applied to the screw closure;

comparing the instantaneous drive torque with a closing torque having a predetermined value; and sensing an angle of rotation of the screw closure only upon the instantaneous drive torque reaching the predetermined value of the closing torque.

6. A method according to claim 5, wherein said drive torque sensing step includes sensing at least one of a current and a voltage of power supply for driving the screw closure.

7. A method according to claim 5, further comprising the step of rotating the screw closure, after the enclosing torque of a predetermined value is reached, a predetermined angular amount.

8. A method according to claim 5, further comprising the step of determining a chronological change of the closing torque.

9. A method according to claim 5, wherein said step of sensing an angle of rotation includes comparing an instantaneous angle of rotation with a predetermined angle of rotation.

10. A method according to claim 5, further comprising the steps of reversal of power supply, and determining an opening moment as soon as a rotational angle of the screw closure exceeds 0°.

11. A method according to claim 5, further comprising the steps of selecting the predetermined closing torque as a limiting torque exceeding a desired closing torque, and rotating the screw closure through a predetermined angle counter a closing direction when the limiting torque is reached.

12. A method according to claim 5, further comprising the step of initiating an additional closing process upon a determination of at least one of a defective angular value and a defective torque value.

13. A method according to claim 5, further comprising the step of sorting out a container upon sensing at least one of a defective angular value and a defective torque value.

* * * * *